US010529504B2

(12) United States Patent
Wu

(10) Patent No.: US 10,529,504 B2
(45) Date of Patent: Jan. 7, 2020

(54) PUSH BUTTON HAVING A PUSH ROD THAT PIVOTS TOWARD AND AWAY FROM A MOVING CONTACT

(71) Applicant: Fuxi Wu, Dongguan (CN)

(72) Inventor: Fuxi Wu, Dongguan (CN)

( * ) Notice: Subject to any disclaimer, the term of this patent is extended or adjusted under 35 U.S.C. 154(b) by 0 days.

(21) Appl. No.: 15/669,953

(22) Filed: Aug. 6, 2017

(65) Prior Publication Data

US 2017/0338064 A1 Nov. 23, 2017

Related U.S. Application Data

(63) Continuation-in-part of application No. PCT/CN2016/072313, filed on Jan. 27, 2016.

(30) Foreign Application Priority Data

Feb. 6, 2015 (CN) ..... 2015 2 0084851 U

(51) Int. Cl.

| | |
|---|---|
| ***H01H 13/10*** | (2006.01) |
| ***H01H 13/14*** | (2006.01) |
| ***H01H 13/20*** | (2006.01) |
| ***H01H 13/50*** | (2006.01) |
| ***H01H 13/02*** | (2006.01) |

(52) U.S. Cl.

CPC ..... *H01H 13/14* (2013.01); *H01H 13/023* (2013.01); *H01H 13/10* (2013.01); *H01H 13/20* (2013.01); *H01H 13/50* (2013.01); *H01H 2219/062* (2013.01); *H01H 2233/07* (2013.01); *H01H 2235/01* (2013.01)

(58) Field of Classification Search

CPC .... H01H 13/18; H01H 13/562; H01H 25/006; H01H 13/14; H01H 13/023; H01H 13/50; H01H 13/10; H01H 13/20; H01H 13/705; H01H 2235/01; H01H 2233/07; H01H 2221/058; H01H 2219/062; H01H 2221/05; H01H 2221/028

See application file for complete search history.

(56) References Cited

U.S. PATENT DOCUMENTS

| | | | | |
|---|---|---|---|---|
| 3,656,181 A * | 4/1972 | Pack | H01H 13/562 | 200/509 |
| 4,803,362 A * | 2/1989 | Butts | H01H 13/50 | 250/229 |
| 7,834,280 B2 * | 11/2010 | Poyner | H01H 27/002 | 200/19.06 |
| 9,362,066 B2 * | 6/2016 | Izawa | H01H 13/023 | |
| 9,934,924 B2 * | 4/2018 | Liang | H01H 50/22 | |

* cited by examiner

*Primary Examiner* — Vanessa Girardi

(74) *Attorney, Agent, or Firm* — Jie Yang; Zanip

(57) ABSTRACT

A keyboard switch, including a base; a static contact; a moving contact; an upper cover; a button configured to control the contact of the static contact and the moving contact; and a reset spring configured to control the reset of the button.

6 Claims, 19 Drawing Sheets

PUSH BUTTON HAVING A PUSH ROD THAT PIVOTS TOWARD AND AWAY FROM A MOVING CONTACT

CROSS-REFERENCE TO RELATED APPLICATIONS

This application is a continuation-in-part of International Patent Application No. PCT/CN2016/072313 with an international filing date of Jan. 27, 2016, designating the United States, now pending, and further claims foreign priority to Chinese Patent Application No. 201520084851.9 filed Feb. 6, 2015. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, and Cambridge, Mass. 02142.

BACKGROUND OF THE INVENTION

Field of the Invention

The present disclosure relates to a push rod type keyboard switch.

Description of the Related Art

Conventionally, an individual keyboard switch includes a base, a static contact, a moving contact, and a button. When a key is depressed, the button drives down the moving contact to contact the static contact to activate the circuit. The contact mode of the button and the moving contact is by direct push, which leads to unsatisfactory user experience.

SUMMARY OF THE INVENTION

In view of the above-described problems, it is one objective of the invention to provide a push rod type keyboard switch which is easy to assemble and exhibits comfortable user experience, and the press control of the keyboard switch is accurate and smooth.

To achieve the above objective, in accordance with one embodiment of the invention, there is provided a push rod type keyboard switch comprising a base, a static contact, a moving contact, an upper cover, a button configured to control the contact of the static contact and the moving contact, and a reset spring; the static contact and the moving contact are disposed on the base; the upper cover is installed on the base; the button is installed on the base, capable of moving upwards and downwards, and exposed out of the upper cover, and an upper end and a lower end of the reset spring abut against the button and the base, respectively.

A push rod for pressing and pushing the moving contact is disposed between the button and the moving contact and comprises at least a press-push part and a slide part. A track is disposed on the button and comprises a baffle block, and a driving track and a reset track which are disposed on two sides of the baffle block. A lower segment of the driving track is an initial cooperative segment, and an upper segment thereof is adjacent to an upper segment of the reset track. The lower segment of the driving track is bulge over the upper segment of the reset track along a horizontal direction. The lower segment of the reset track is adjacent to the lower segment of the driving track and bulge over the lower segment of the driving track along the horizontal direction; further, limit steps are formed between the lower segment of the driving track and the lower segment of the reset track.

In a free state, the slide part of the push rod is positioned at the lower segment of the driving track and limited by the limit steps; when the button is pressed, the slide part of the push rod slides upwards along the driving track to an upper segment of the reset track, and the press-push part of the push rod pushes the moving contact to be in contact with the static contact at this moment; and after the button is released, under the action force of a reset spring, the slide part of the push rod slides downwards along the reset track to the lower segment of the driving track, and is limited by the limit steps again.

In a class of this embodiment, the upper segment of the driving track is connected with the upper segment of the reset track through the limit steps in a transitional way, or through a slope or arc surface in a tapered transitional way.

In a class of this embodiment, the push rod is a U-shaped structure, comprises a transverse top arm, a transverse bottom arm and a vertical side arm which is integrated with and connects ends edges of the transverse top arm and the transverse bottom arm; the slide part is disposed on a rear end of the transverse top arm; and the press-push part is disposed at a front side of the vertical side arm.

In a class of this embodiment, the base extends upwards out of a guide column; a side face of the guide column is provided with a limit groove comprising a side opening facing outward; and the rear end of the transverse bottom arm extends into the limit groove.

In a class of this embodiment, the moving contact is a horizontal U-shaped structure, comprises a horizontal fixed arm, a horizontal elastic arm and a bending arm which is integrated with and connects ends of the horizontal fixed arm and the horizontal elastic arm; a free end of the horizontal elastic arm is provided with a first contact part; and the static contact is provided with a second contact part fitting the first contact part.

In a class of this embodiment, a center of the button is provided with a first through hole, and the base is provided with a second through hole correspondingly; the first through hole faces and communicates with the second through hole directly in longitudinal direction; and a light source is disposed facing or in the first through hole.

In a class of this embodiment, a light guide column is disposed above the light source; and a light-emitting surface is disposed on a top end of the light guide column.

In a class of this embodiment, a fourth through hole is disposed on the base and deviates from a center of the base, and the light source is disposed in the fourth through hole; the place of the upper cover facing the light source is provided with a solid light transmission part or provided with a light transmission through hole; and a top end of the solid light transmission part is a light-emitting surface.

In a class of this embodiment, the solid light transmission part is integrated with the upper cover, therefore the whole upper cover is a non-opaque body.

Advantages of the keyboard switch according to embodiments of the invention is as follows. Specifically, the push rod for pressing and pushing the moving contact is disposed between the button and the moving contact mainly, and the track allowing the push rod to slide is disposed on the key; in this way, the slide part of the push rod is limited by the lower segment of the driving track in a free state; when the button is pressed, the slide part of the push rod slides upwards along the driving track to an upper segment of the reset track, and the press-push part of the push rod pushes the moving contact to be in contact with the static contact;

and after the button is released, under the action force of the reset spring, the slide part of the push rod slides downwards along the reset track to the lower segment of the driving track, and is limited by the lower segment of the driving track again. As a result, the push rod type keyboard switch is simple in structure and easy to assemble, and exhibits comfortable user experience; and the pressing control of the keyboard switch is accurate and smooth.

Figure 1:
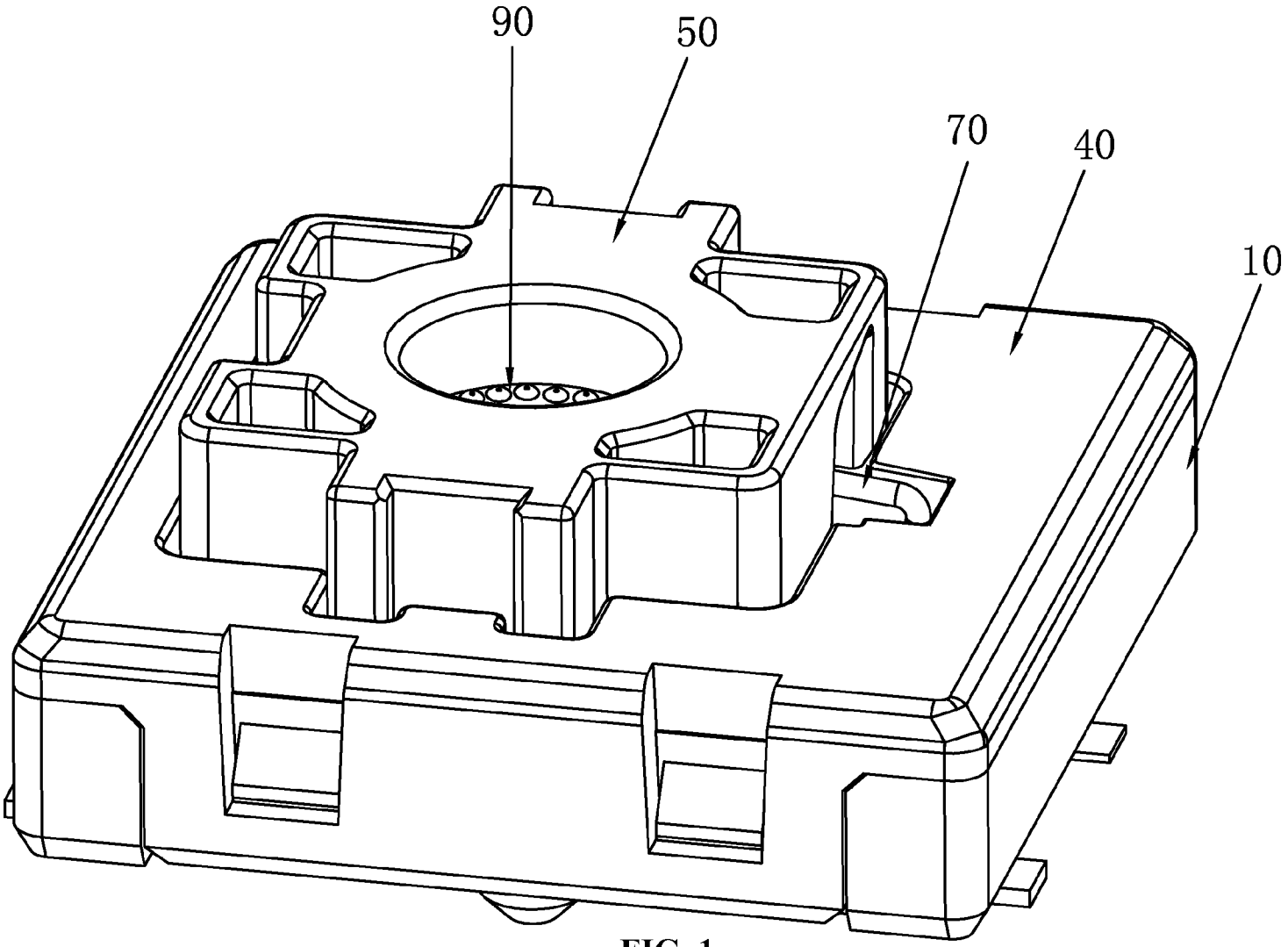
FIG. 1 is a stereogram of a keyboard switch according to the first embodiment of the invention.
Figure 2:
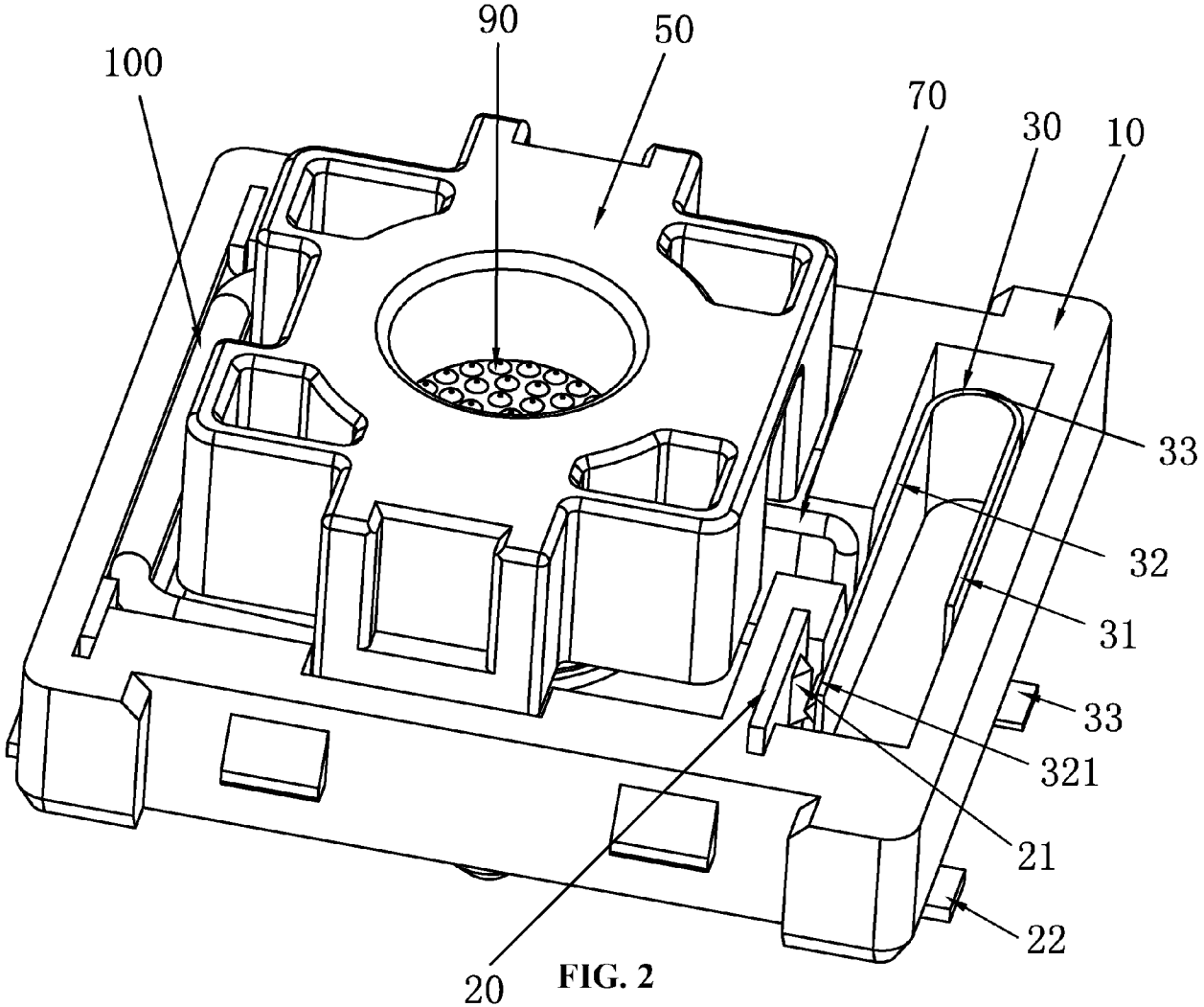
FIG. 2 is a stereogram of a keyboard switch without an upper cover according to the first embodiment of the invention.

In the drawings, the following reference numbers are used: 10. Base; 101. Base plate; 102, Base sidewall; 1011. Base surface; 11. Guide column; 12. Limit groove; 13. First through hole; 14. Fourth through hole; 20. Static contact; 21. Second contact part; 22. First pin; 23. Second pin; 30. Moving contact; 31. Horizontal fixed arm; 32. Horizontal elastic arm; 33. Bending arm; 321. First contact part; 33. Third pin; 34. Fourth pin; 40. Upper cover; 41. Solid light transmission part; 42. Light guide convex point; 50. Button; 501. Press plate; 502. First button column; 503. Second button column; 5011. Inner plate surface; 5031. Outer button surface; 504. Gap; 505. Void space; 51. Baffle block; 52. Driving track; 53. Reset track; 54. Limit steps; 541. first limit surface; 542. second limit surface; 55. Steps; 56. Slope or arc surface; 57. Second through hole; 60. Reset spring; 70. Push rod; 71. Transverse top arm; 72. Transverse bottom arm; 73. Vertical side arm; 80. Light source; 90. Light guide column; 91. Light-emitting surface; 92. Light guide convex point; 100. Balance rod.

DETAILED DESCRIPTION OF THE EMBODIMENTS

As shown in FIGS. 1-12, a push rod type keyboard switch of a first embodiment of the present disclosure is displayed. The push rod type keyboard switch comprises a base 10, a static contact 20, a moving contact 30, an upper cover 40 and a button 50 contacting with the static contact 20 in order to control movement of the moving contact 30; the base 10 comprises a base sidewall 102 and a base plate 101 having a base surface 1011; the static contact 20 and the moving contact 30 are disposed on the base 10; the upper cover 40 is installed on the base 10; the button 50 comprises a press plate 501, a first button column 502, and a second button column 503; the press plate 501 comprises an inner plate surface 5011; a gap 504 is disposed between the first button column 502 and the second button column 503; the second button column 503 comprises an outer button surface 5031 and a limit step 54; the limit step 54 comprises a first limit surface 541 and a second limit surface 542; a void space 505 is defined by the inner plate surface 5011, the outer button surface 5031, and the first limit surface 541; the button 50 is disposed on the base 10 in the way of moving up and down and exposed outside the upper cover 40; and in allusion to that the button 40 is provided with a reset spring 60, an upper end and a lower end of the reset spring 60 are abutted against the button 50 and the base 10, respectively.

Figure 5:
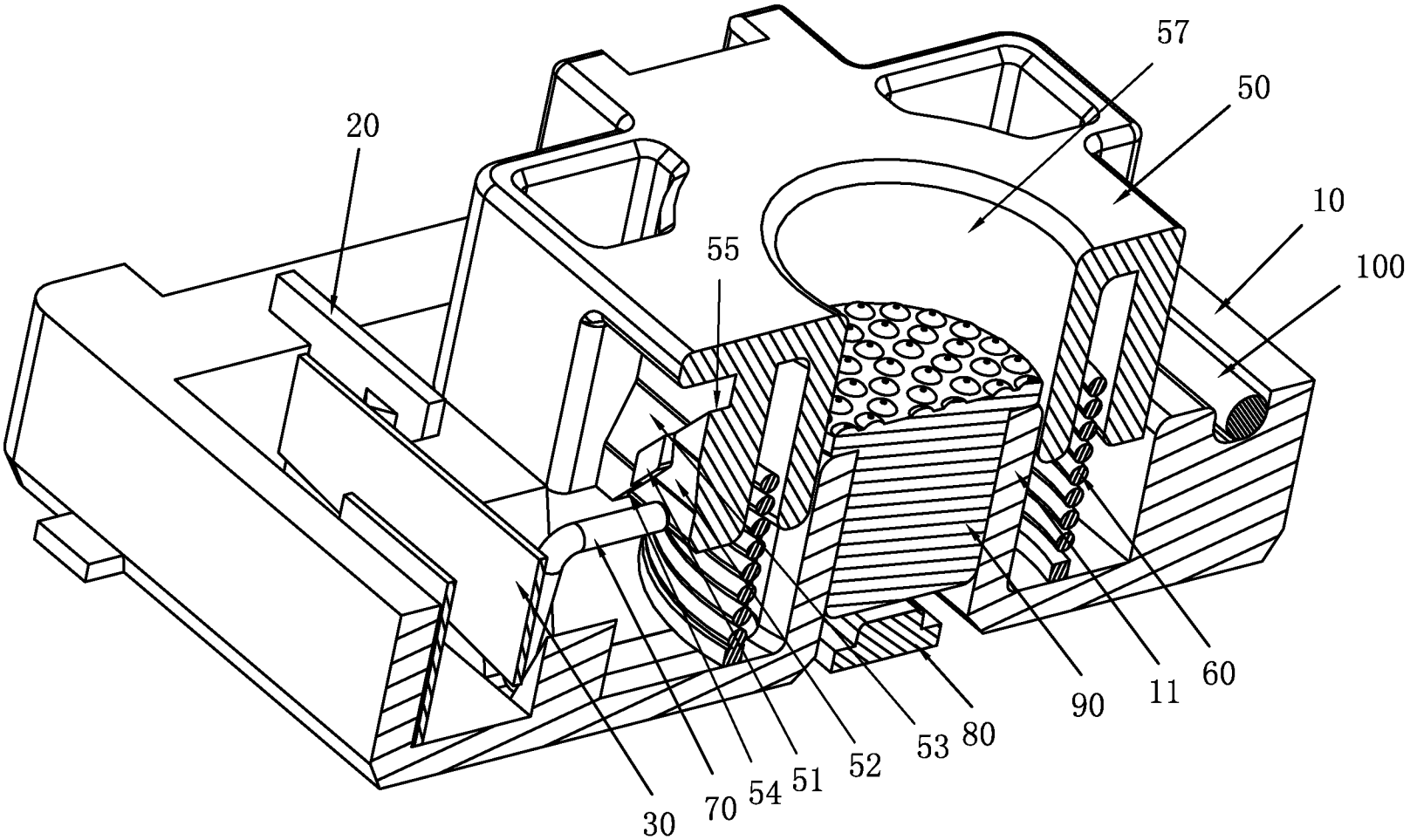
FIG. 5 is a sectional view of a sound keyboard switch according to the first embodiment of the invention.
Figure 8A:
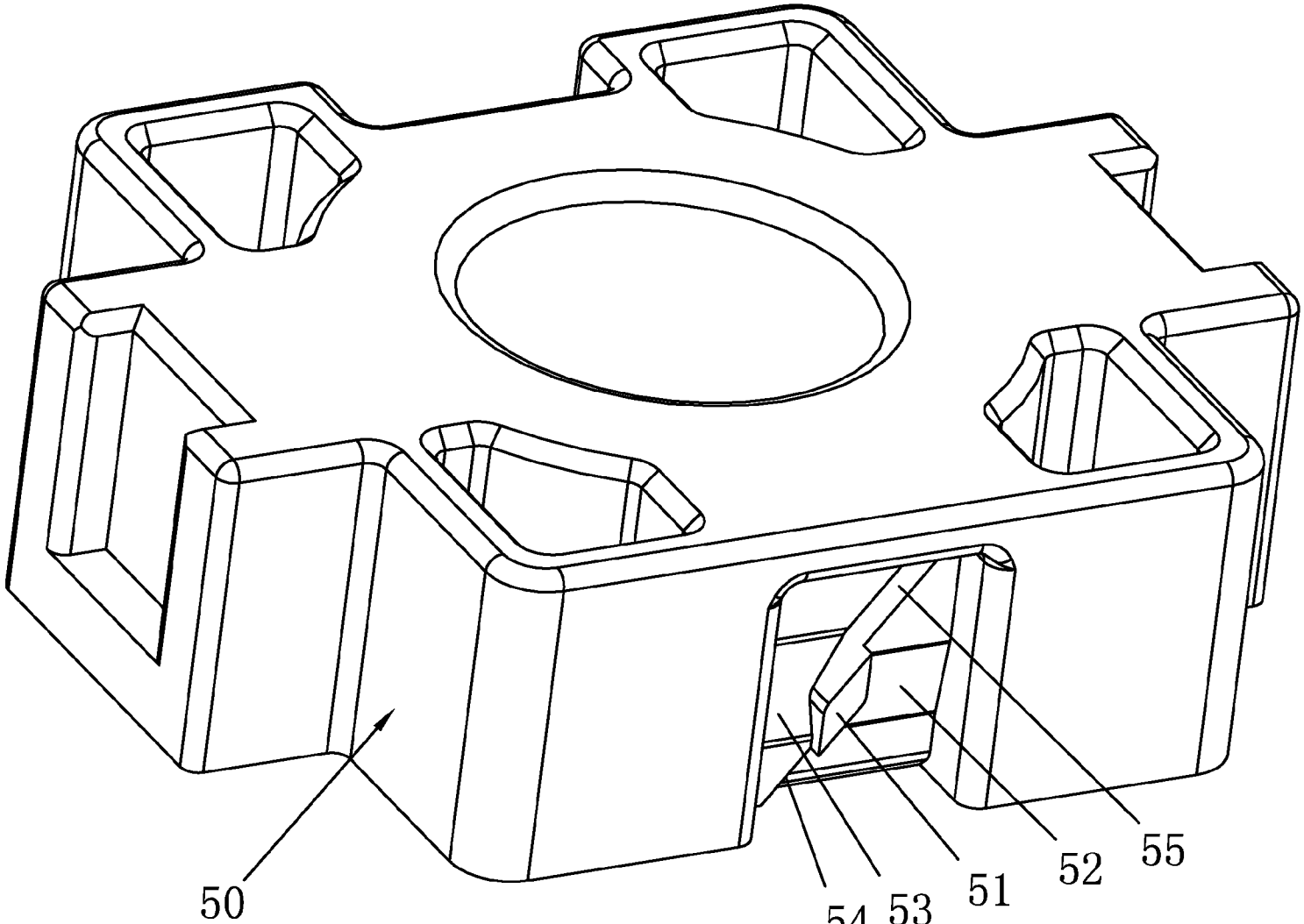
FIG. 8A is a schematic diagram of a button of a sound keyboard switch according to the first embodiment of the invention.

A push rod 70 for pressing and pushing the moving contact 30 is disposed between the button 50 and the moving contact 30 and comprises at least a press-push part and a slide part. As shown in FIG. 5 and FIG. 8A, a track is disposed on the button 50; the track comprises a baffle block 51 and a driving track 52 and a reset track 53 which are disposed on two sides of the baffle block 51. A lower segment of the driving track 52 is an initial cooperative segment, and an upper segment thereof is adjacent to the upper segment of the reset track 53. The lower segment of the driving track 52 is bulge over the upper segment of the reset track 53 along the horizontal direction. The lower segment of the reset track 53 is adjacent to the lower segment of the driving track 52 and bulge over the lower segment of the driving track 52 along the horizontal direction; further, limit steps 54 are formed between the lower segment of the driving track 52 and the lower segment of the reset track 53.

Further, as shown in FIGS. 2-5, a balance rod 100 is disposed between the base 10 and the button 50; and due to the balance rod 100, the button would not be tilted easily when pressed, in this way the hand feel is smooth when the switch is pressed without blocking.

Figure 9:
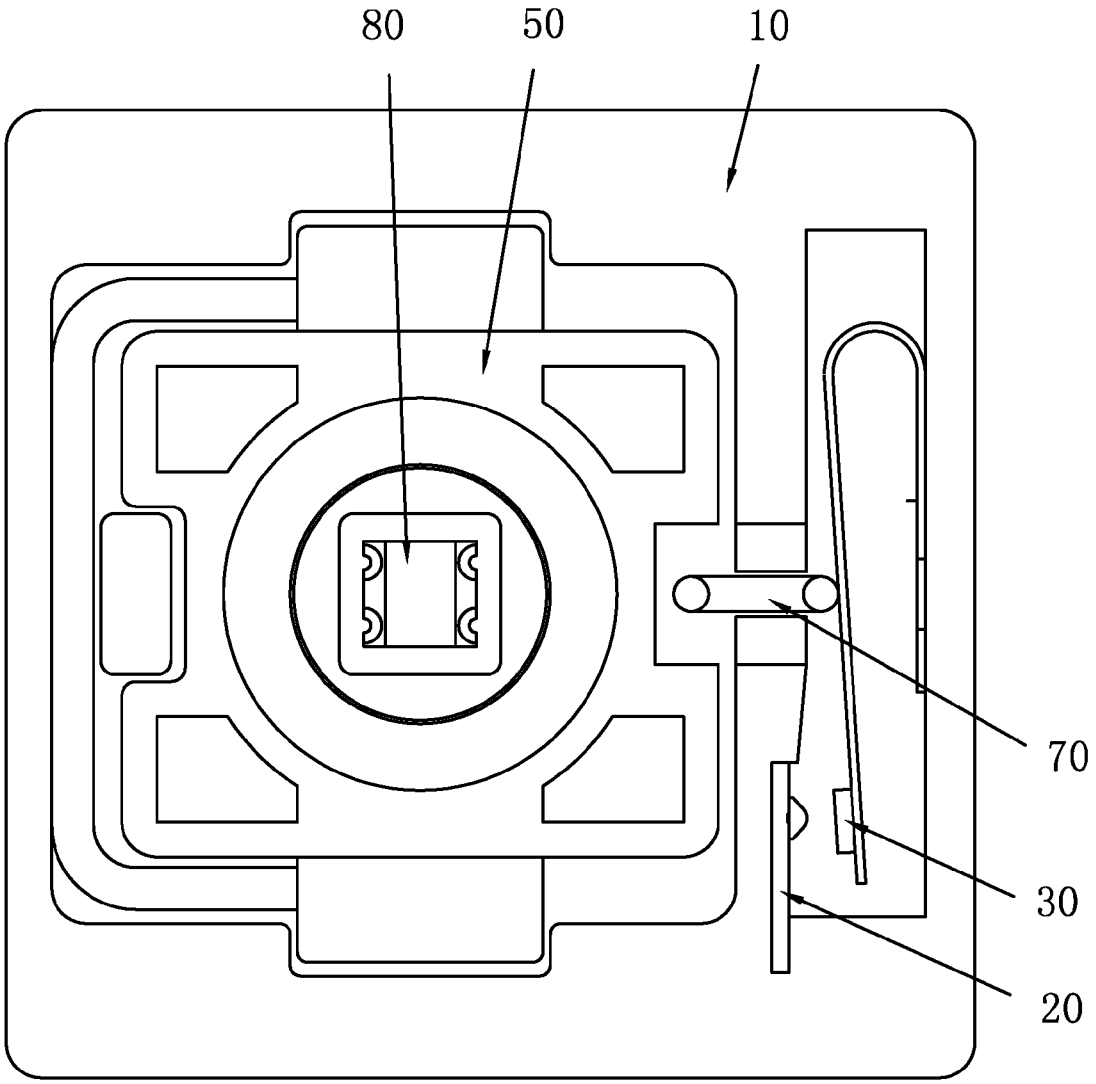
FIG. 9 is a schematic diagram of a keyboard switch in the free state (disconnected) according to the first embodiment of the invention.
Figure 10:
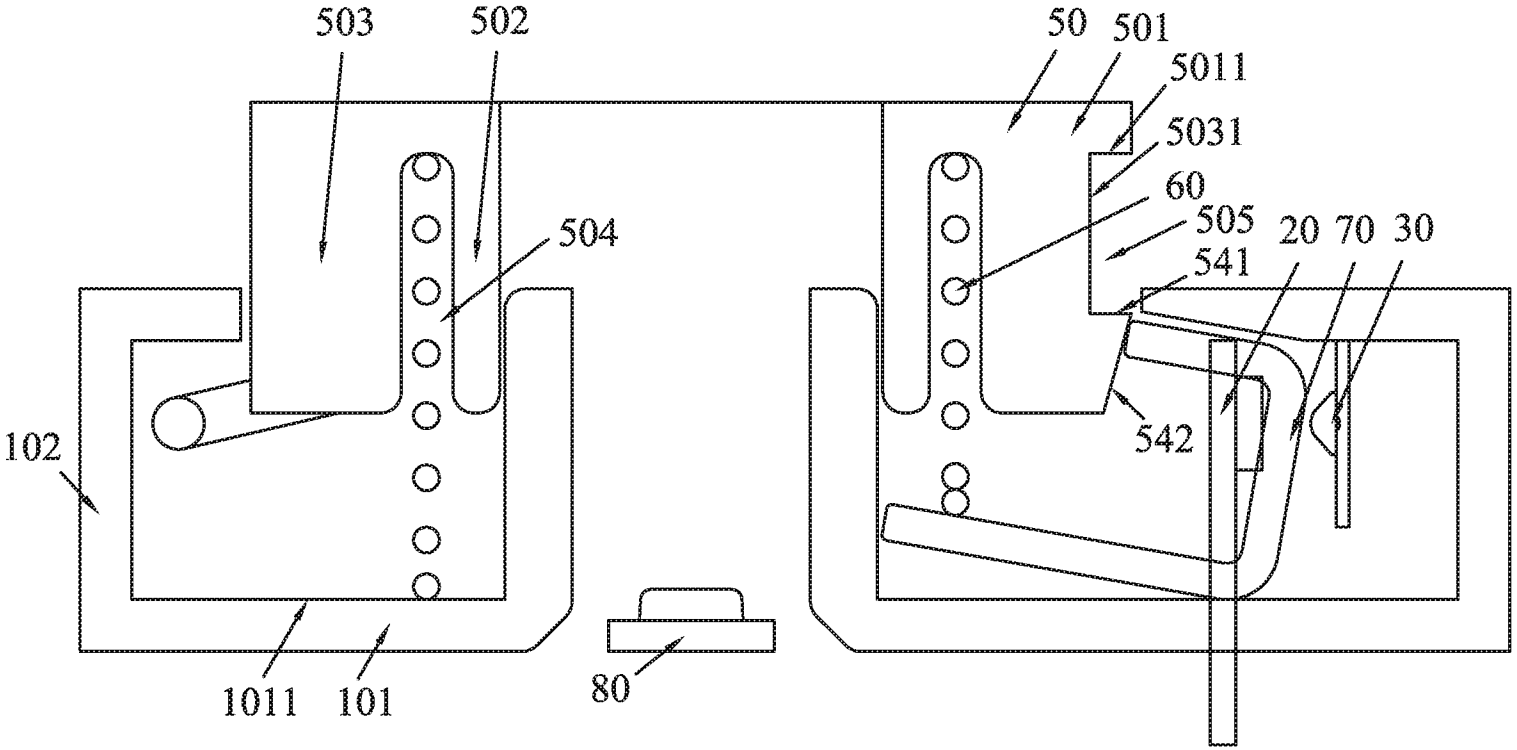
FIG. 10 is a schematic diagram of another keyboard switch in the free state (disconnected) according to the first embodiment of the invention.
Figure 11:
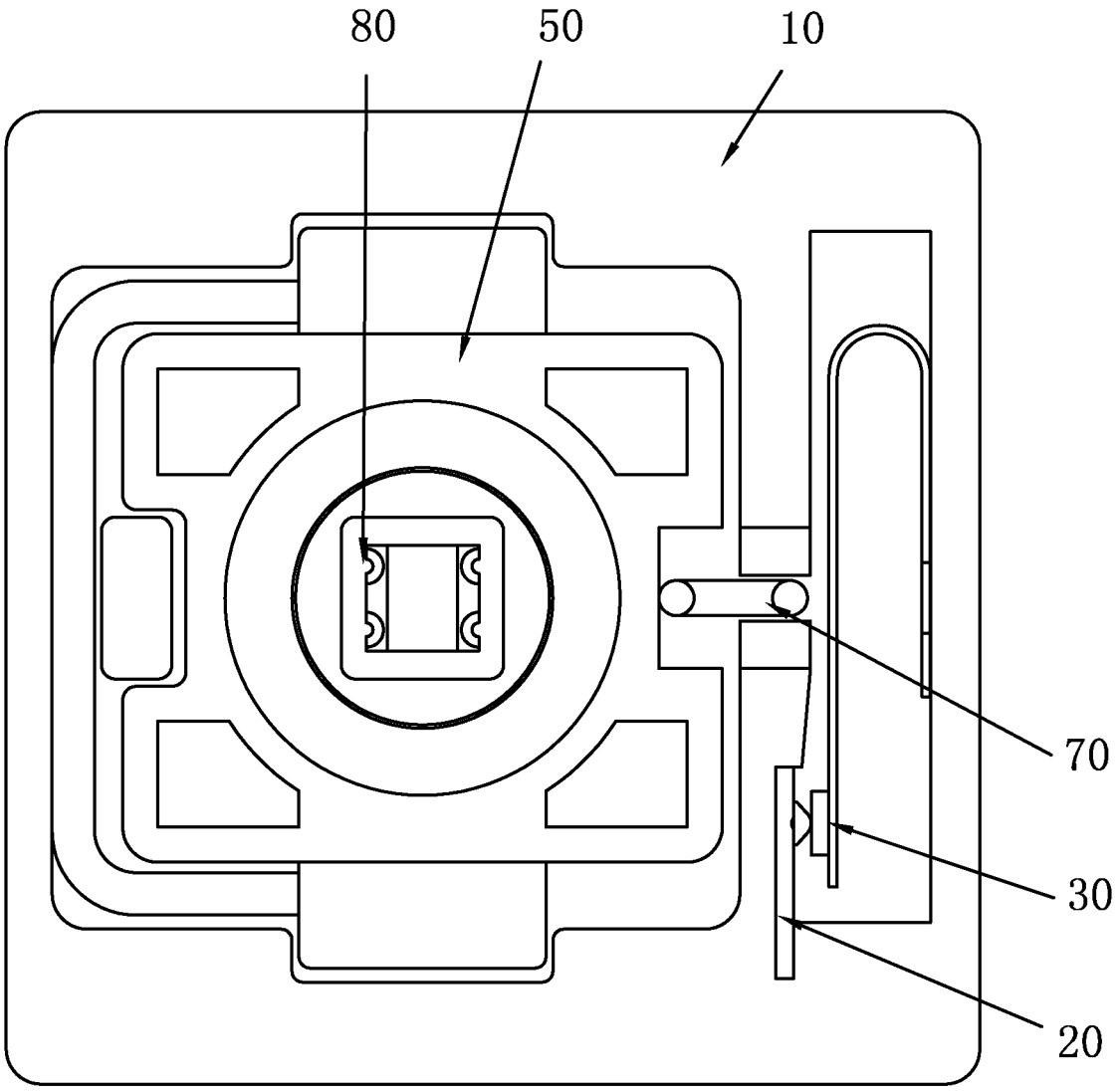
FIG. 11 is a schematic diagram of a keyboard switch in the press state (connected) according to the first embodiment of the invention.
Figure 12:
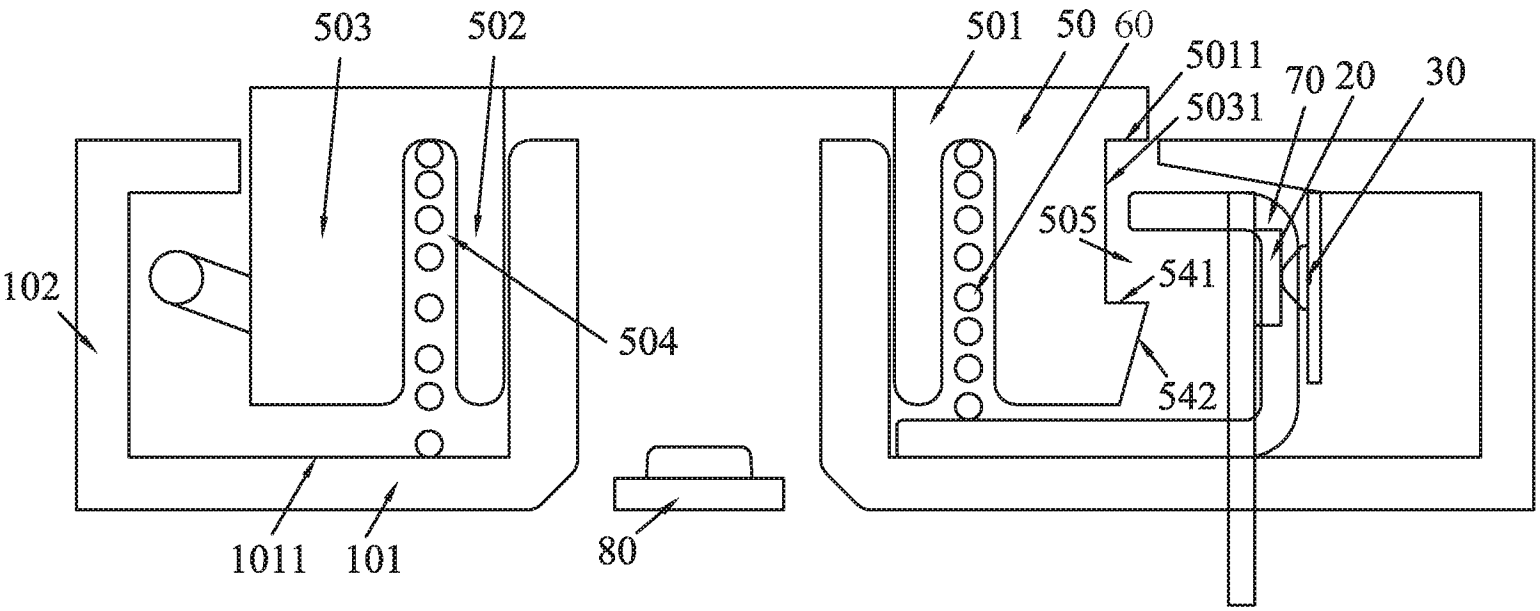
FIG. 12 is a schematic diagram of another keyboard switch in the press state (connected) according to the first embodiment of the invention.
Figure 13:
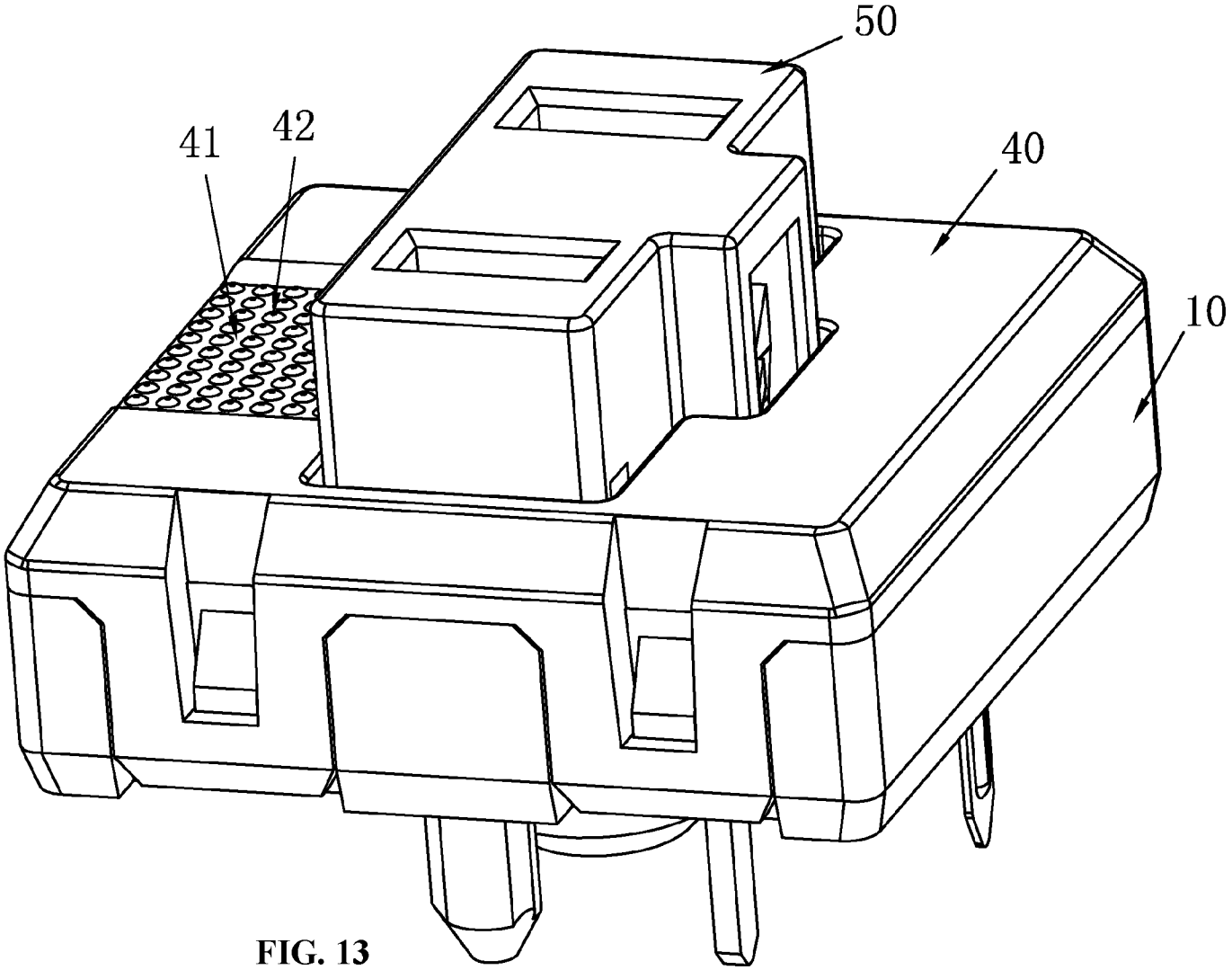
FIG. 13 is a stereogram of another keyboard a keyboard switch according to the second embodiment of the invention.

With reference to FIG. 5, FIG. 9 and FIG. 10, in a free state, the slide part of the push rod 70 is positioned at the lower segment of the driving track 52 and limited by the limit steps 54; when the button 50 is pressed, the slide part of the push rod 70 slides upwards along the driving track 52 to an upper segment of the reset track 53, and the press-push part of the push rod 70 pushes the moving contact 30 to be in contact with the static contact 20 at this moment; and after the button 50 is released, under the action force of the reset spring 60, the slide part of the push rod 70 slides downwards along the reset track 53 to the lower segment of the driving track 52, and is limited by the limit steps 54 again.

Figure 6:
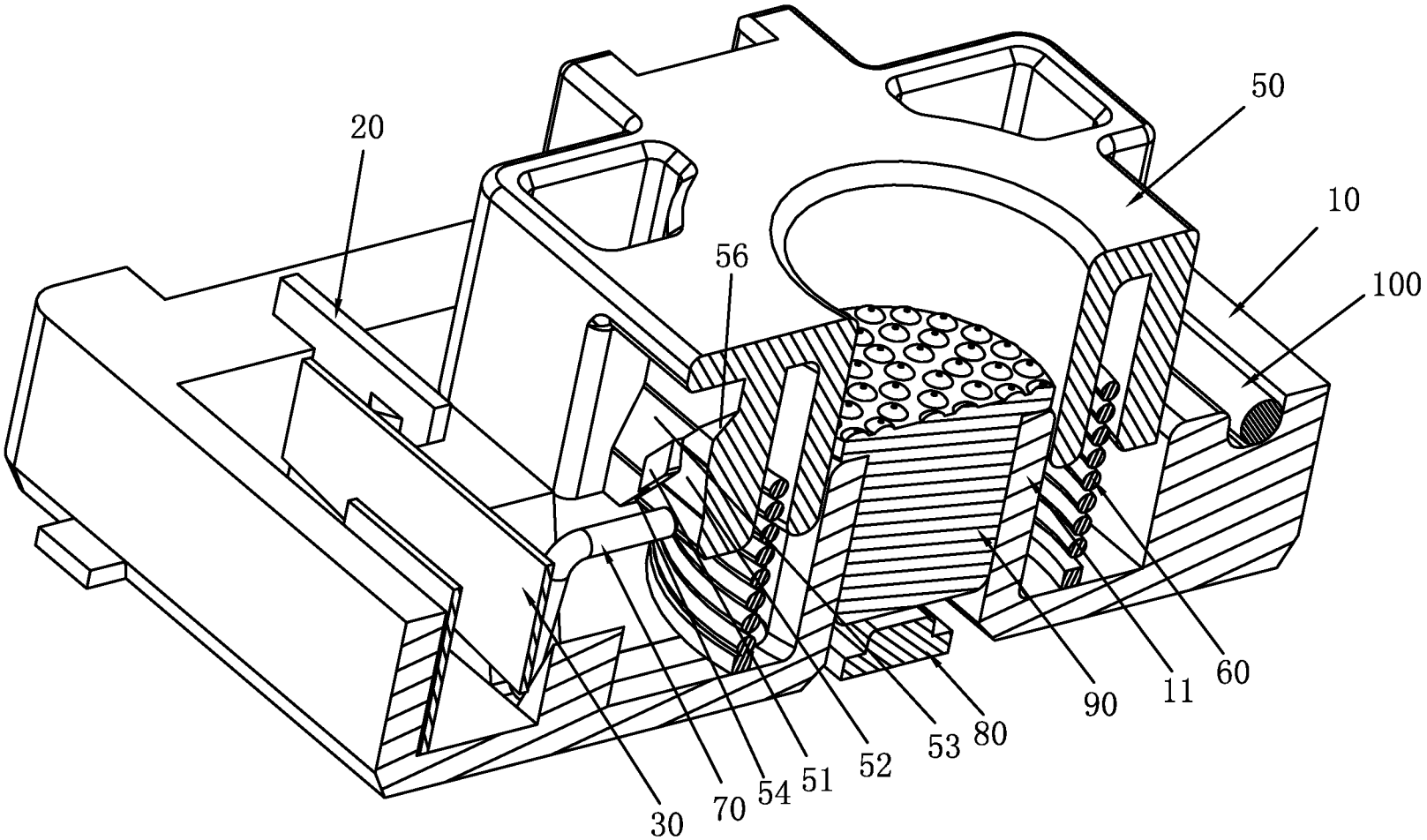
FIG. 6 is a sectional view of a silent keyboard switch according to the first embodiment of the invention.
Figure 7:
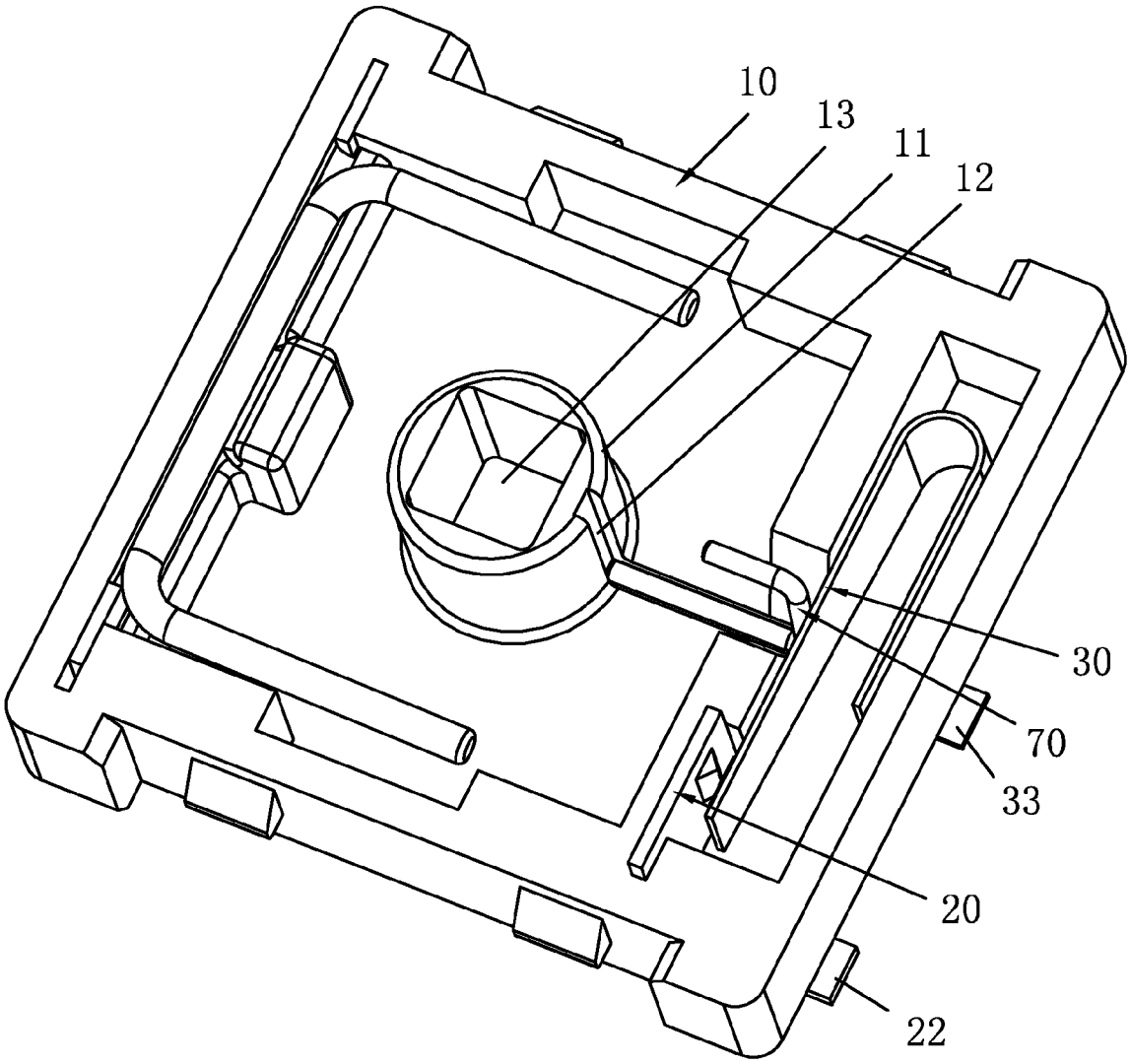
FIG. 7 is a local view of a keyboard switch according to the first embodiment of the invention.
Figure 8B:
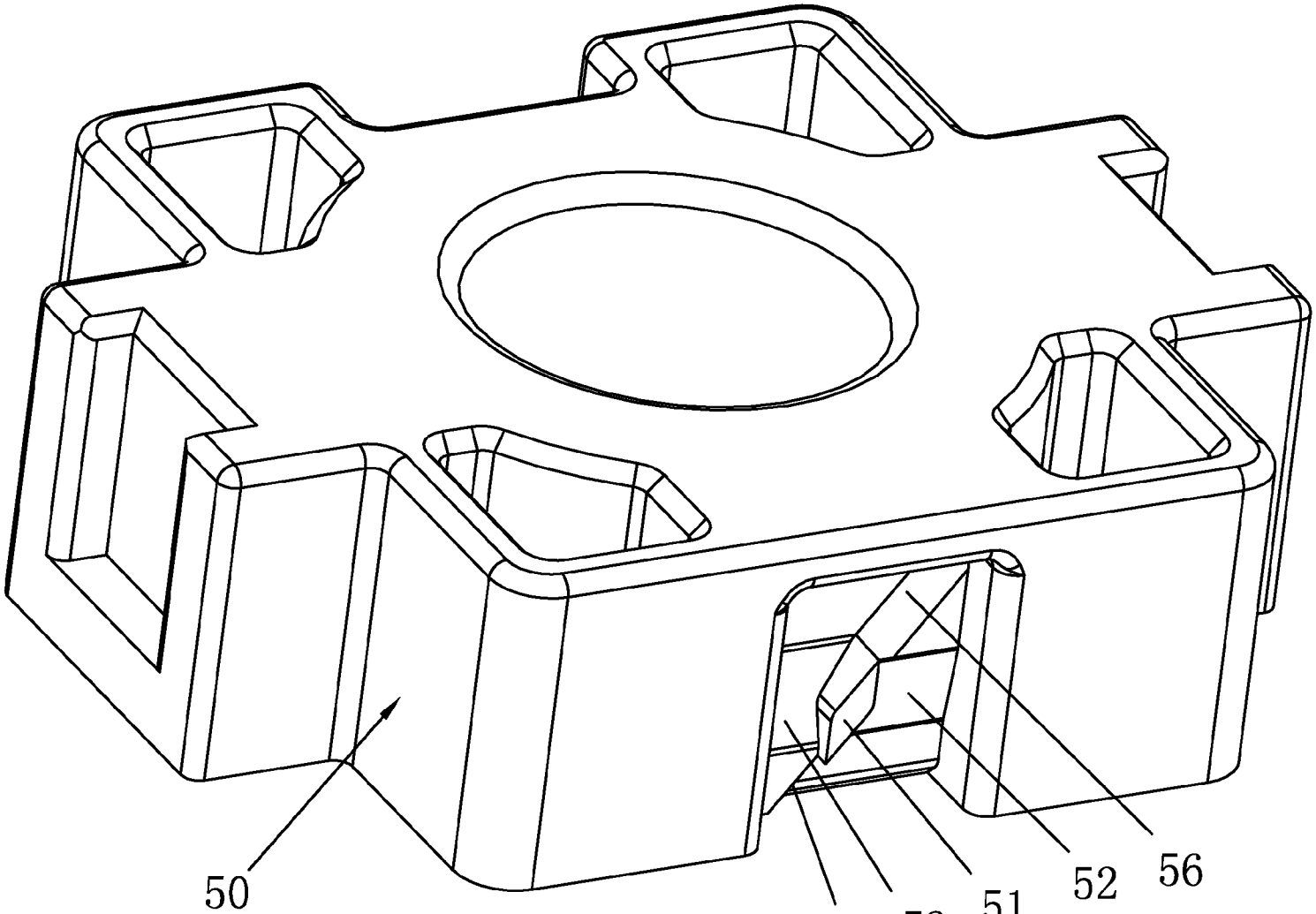
FIG. 8B is a schematic diagram of a button of a silent keyboard switch according to the first embodiment of the invention.

The push rod type keyboard switch can be designed as the sound keyboard switch or silent keyboard switch; specifically speaking, the upper segment of the driving track 52 is connected with the upper segment of the reset spring 53 through the steps 55 in transitional way as shown in FIG. 5 and FIG. 8A; therefore, when the button 50 is pressed, the slide part of the push rod 70 longitudinally enters into the upper segment of the reset track 53 through the steps 55 from the upper segment of the driving track, with a clicking sound which is good for reminding the operator to press in place and is equal to a switch-on prompt. As shown in FIG. 6 and FIG. 8B, the transition of the steps 55 is designed as the gradual and transitional connection through a slope or an arc surface 56; when the button 50 is pressed, the slide part of the push rod 70 gradually enters into the upper segment of the reset track 53 in sliding manner from the upper segment of the driving track 52, without the clicking sound.

With reference to FIG. 2, FIG. 3, FIG. 5 and FIG. 7, in the embodiment, the push rod 70 is a U-shaped structure, comprises a transverse top arm 71, a transverse bottom arm 72 and vertical side arms 73 which are integrated and connected between front end edges of the transverse top arm 71 and the transverse bottom arm 73; the slide part is disposed on a rear end of the transverse top arm 71; and the press-push part is disposed at a front side of the vertical side arm 73. The base 10 extends upwards out of a guide column 11; a side face of the guide column 11 is provided with a limit groove 12 which has a side opening facing outward; and the rear end of the transverse bottom arm 71 extends into the limit groove 12.

Figure 3:
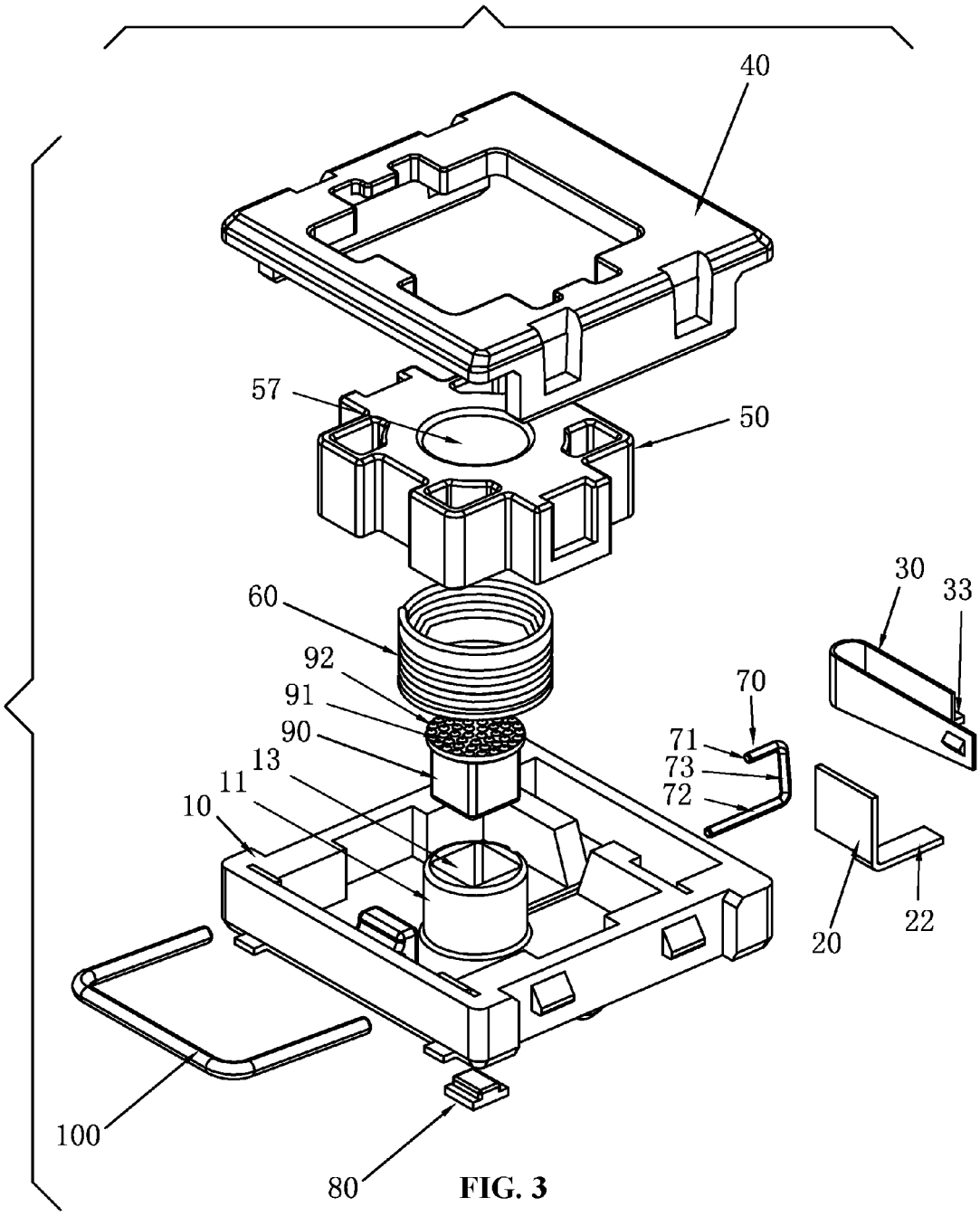
FIG. 3 is an exploded view of a keyboard switch according to the first embodiment of the invention.
Figure 4:
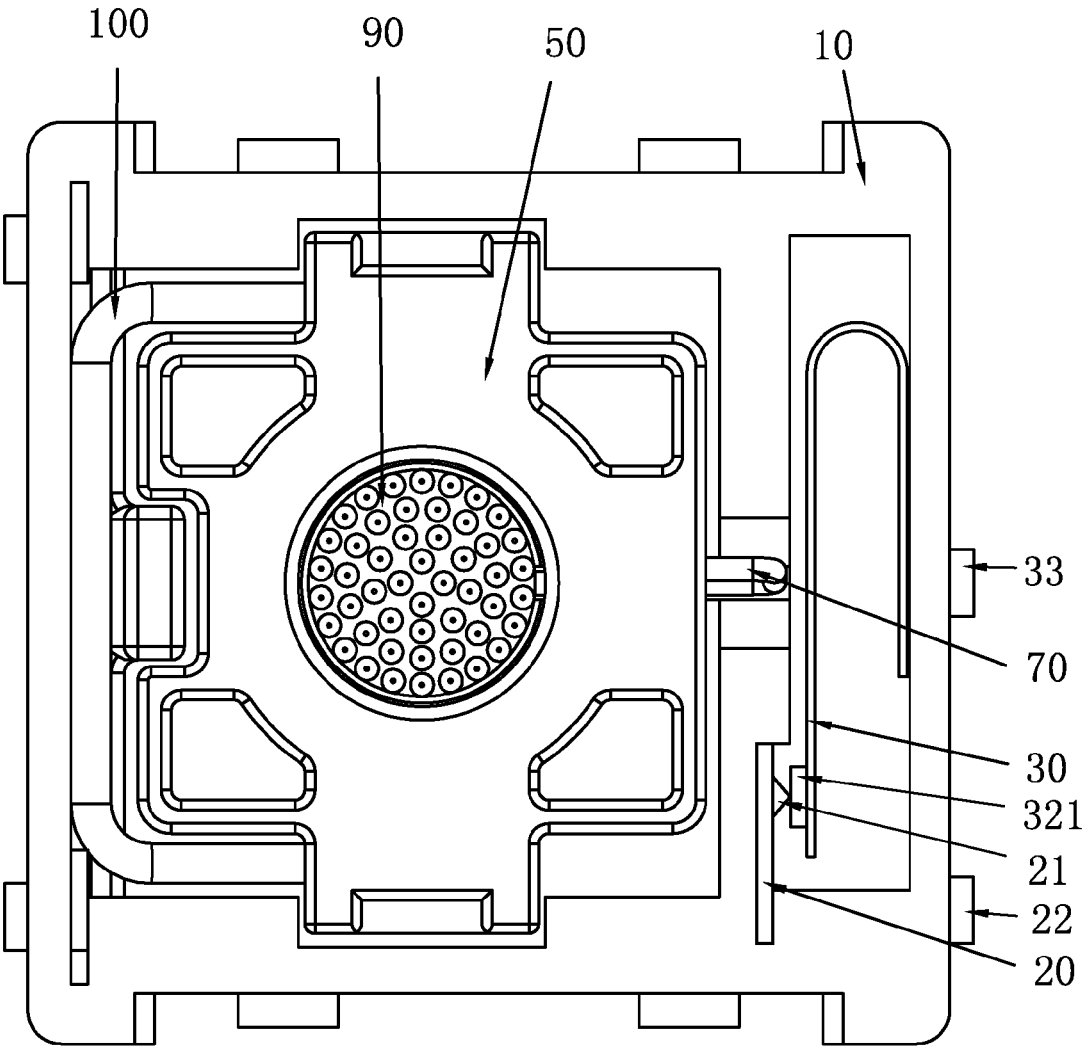

As shown in FIG. 3, the moving contact 30 is a horizontal U-shaped structure, comprises a horizontal fixed arm 31, a horizontal elastic arm 32 and a bending arm 33 integrated and connected between ends of the horizontal fixed arm 31 and the horizontal elastic arm 32; a free end of the horizontal elastic arm 32 is provided with a first contact part 321; and the static contact 20 is provided with a second contact part 21 fitting the first contact part 321.

As shown in FIGS. 1-12, the keyboard switch is designed as the keyboard switch emitting light from the center; the center of the button 50 is provided with a first through hole 57, and the base 10 is provided with a second through hole 13 correspondingly; the first through hole 57 faces and communicates with the second through hole 13 directly in longitudinal direction; and a light source 80 and a light guide column 90 facing or in the first through hole 57 and the second through hole 13 are disposed orderly from bottom to top. The light source 80 can be the plugin LED lamp or SMD LED, or other type light source, with single or multiple colors (not limited here). A top end of the light guide column 90 is taken as a light-emitting surface 91 on which multiple light guide convex points 92 improving the light-out effect protrude; or the light-emitting surface 91 can also be designed as the smooth surface. Of course, the light guide column 90 can be disposed selectively; and the light-out effect of the center can be implemented in absence of the light guide column.

As shown in FIGS. 13-18, the specific structure of the second embodiment of the present disclosure is displayed, with main structure identical to that of the previous embodiment; and the main difference is that the keyboard switch in this embodiment is designed as the keyboard switch emitting light from the side. Specifically speaking, a fourth through hole 14 is disposed on the base and deviates from the center of the base 10, and the light source is disposed in the fourth through hole 14; the place of the upper cover 80 facing the light source 80 is provided with a solid light transmission part 41 or provided with a light transmission through hole; and the top end of the solid light transmission part 41 is taken as the light-emitting surface. Of course, the light-emitting surface can be designed as the smooth surface or provided with light guide convex points 42 selectively. Further, the solid light transmission part 41 and the upper cover 40 are formed integrally; and the whole upper cover 40 is a non-opaque body.

Figure 14:
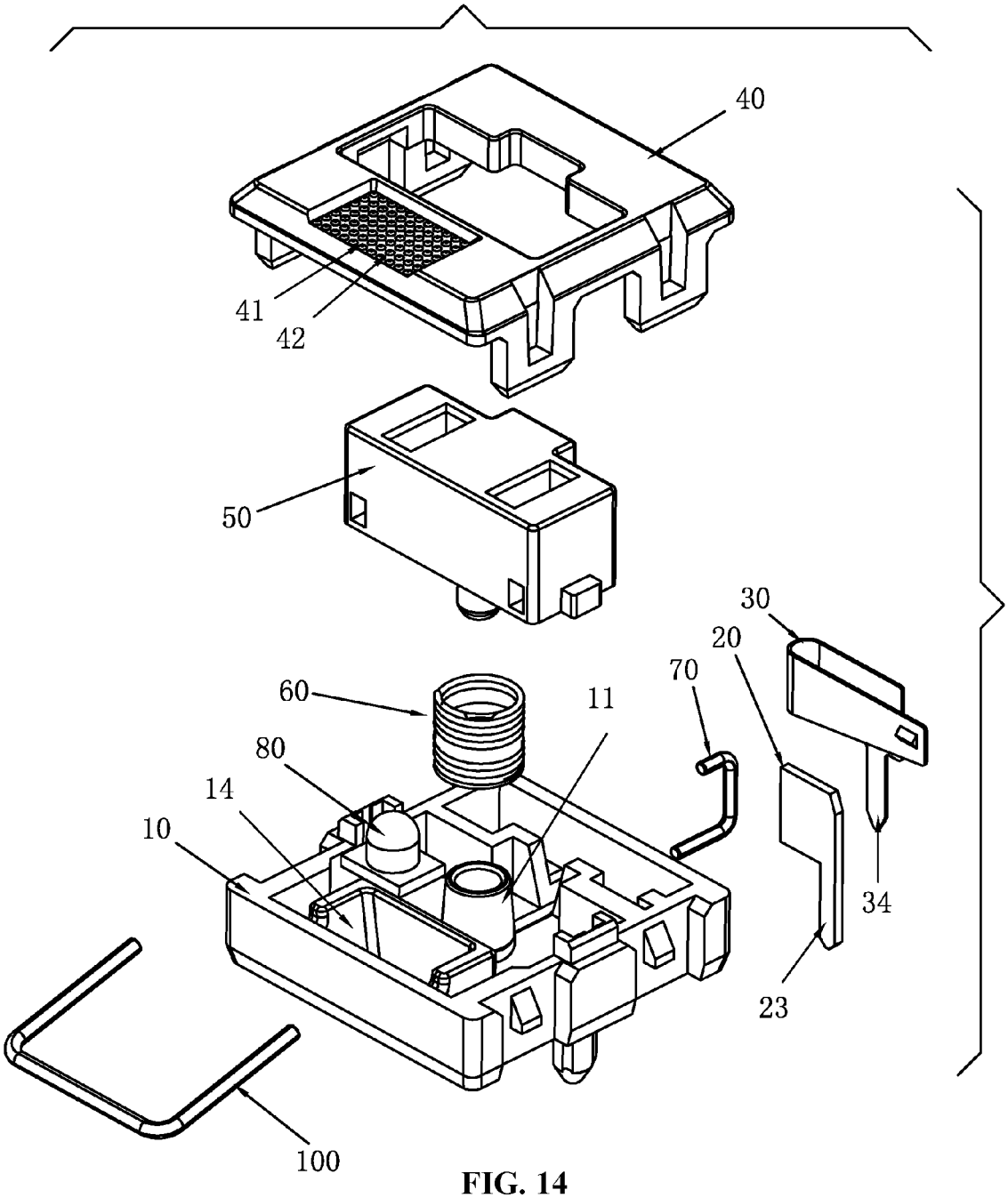
FIG. 14 is an exploded view of another keyboard a keyboard switch according to the second embodiment of the invention.
Figure 15:
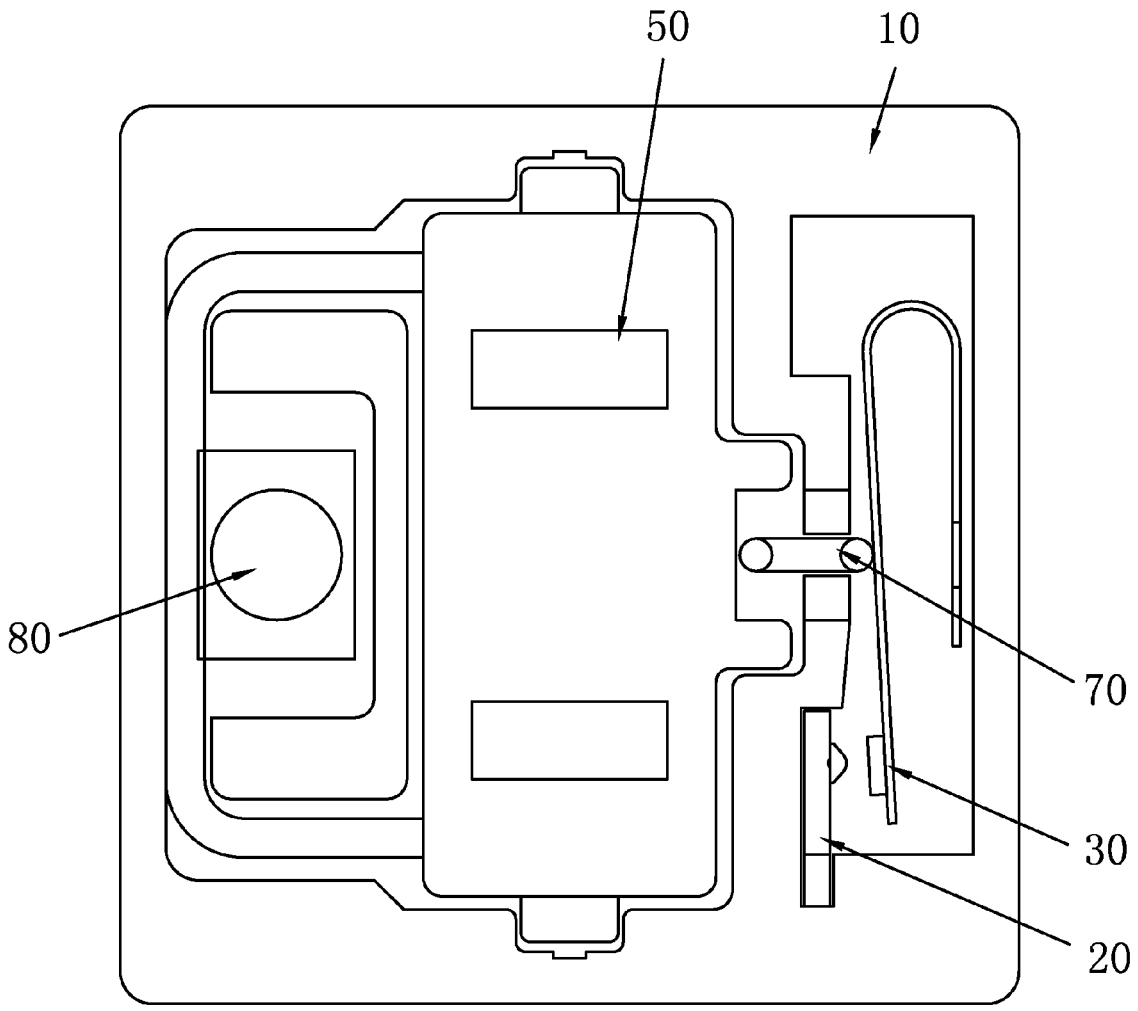
FIG. 15 is a schematic diagram of a keyboard switch in the free state (disconnected) according to the second embodiment of the invention.
Figure 16:
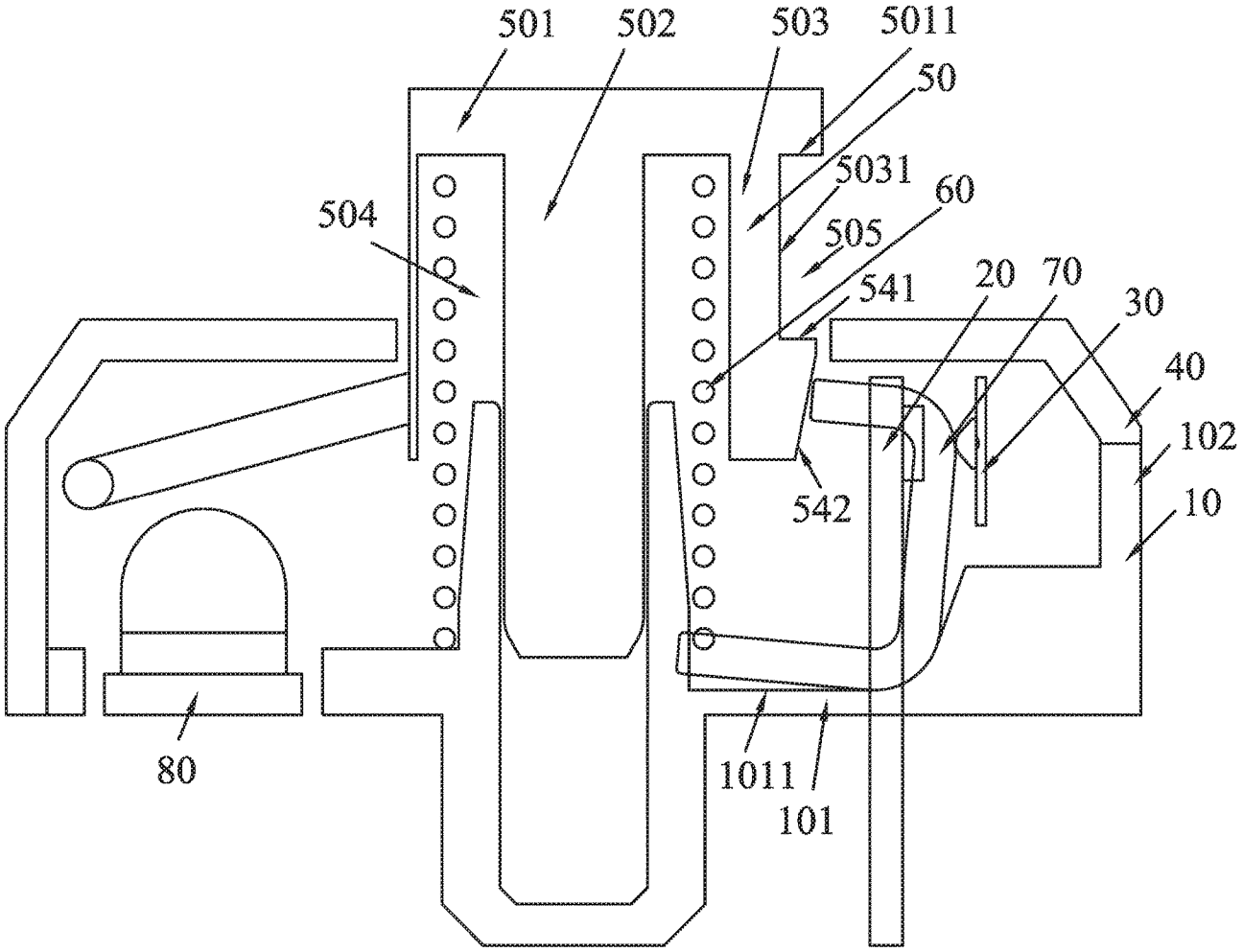
FIG. 16 is a schematic diagram of another keyboard a keyboard switch in the free state (disconnected) according to the second embodiment of the invention.
Figure 17:
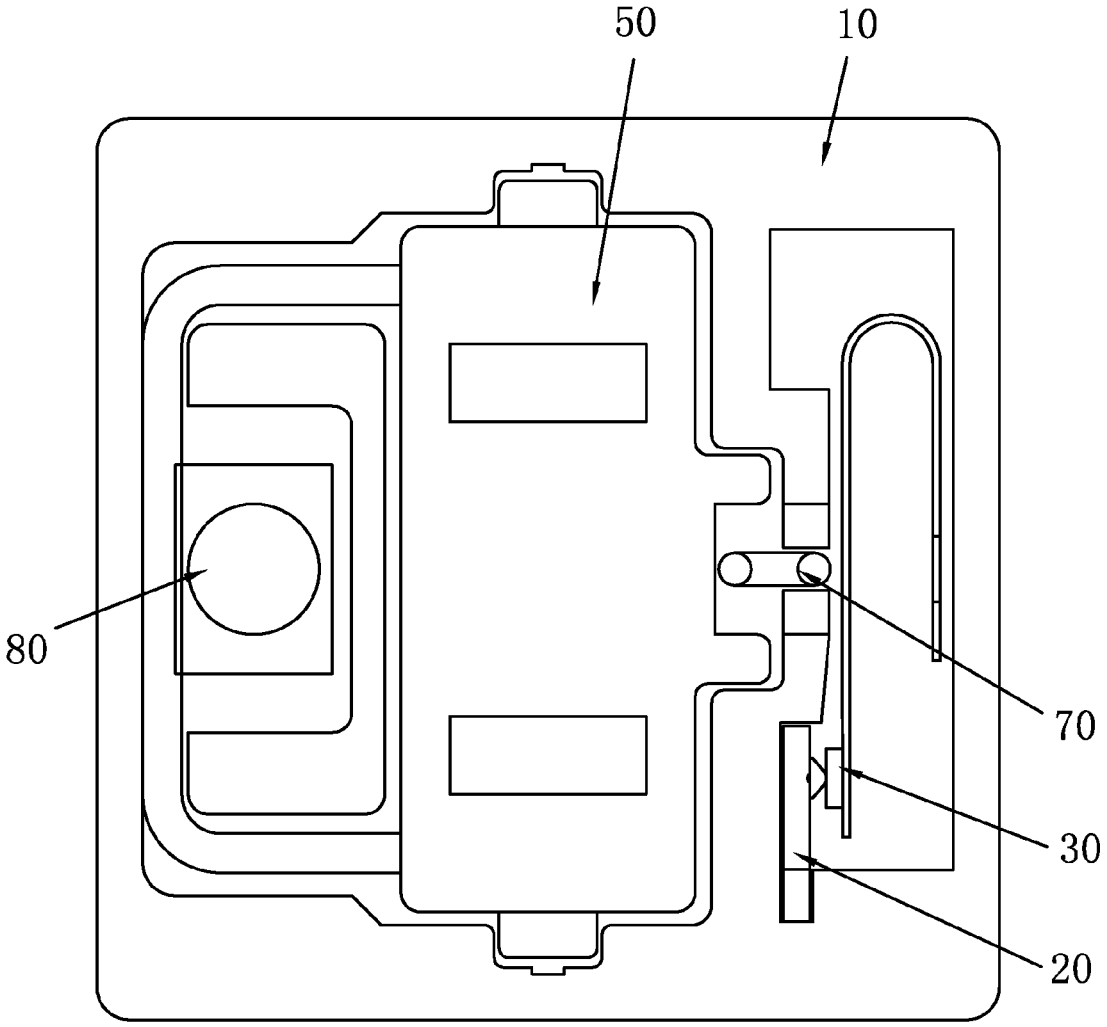
FIG. 17 is a schematic diagram of a keyboard switch in the press state (connected) according to the second embodiment of the invention.
Figure 18:
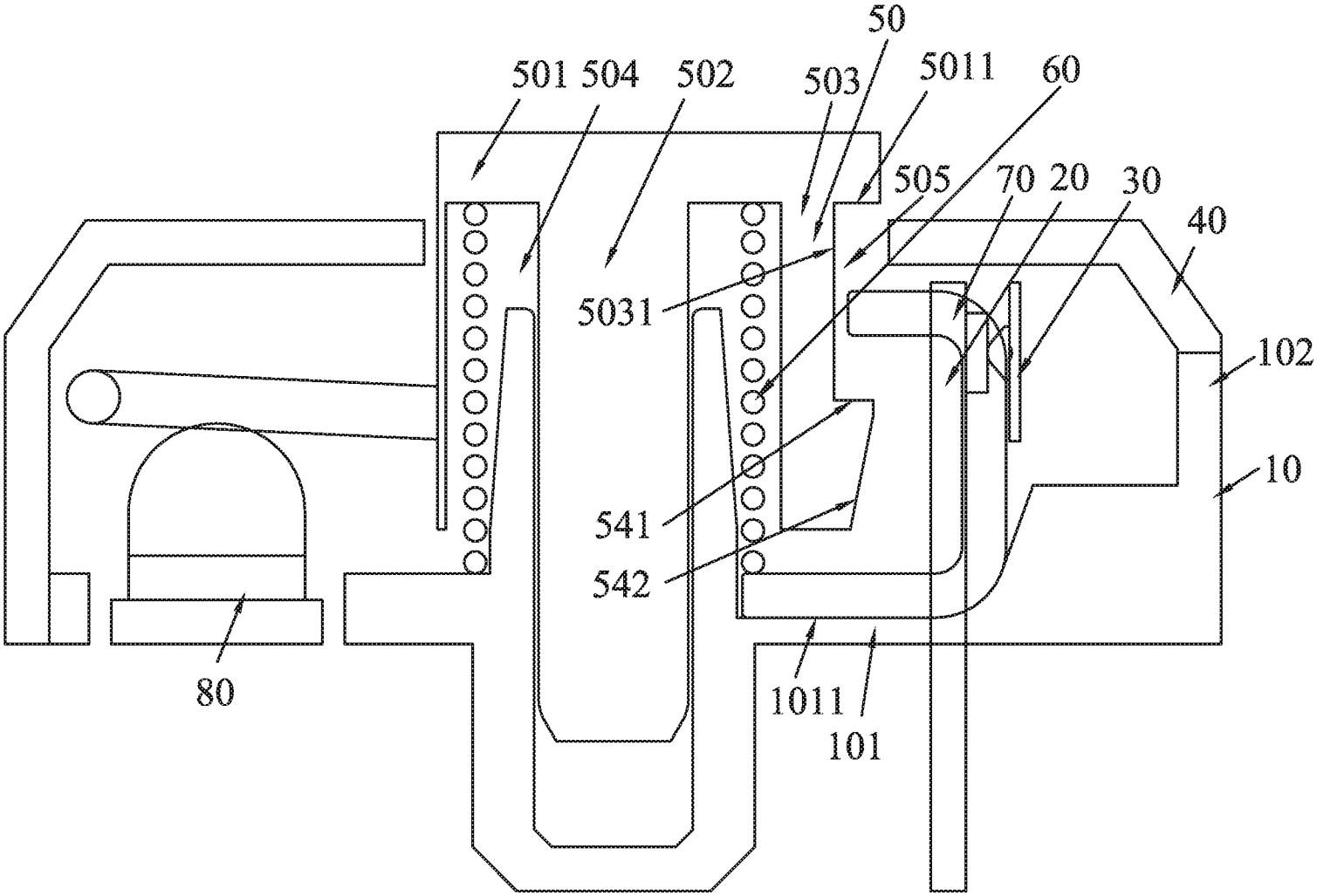
FIG. 18 is a schematic diagram of a keyboard switch in the press state (connected) according to the second embodiment of the invention.

Further, it should be noted that, two pins with different structures are shown in FIG. 3 and FIG. 14; the first pin 22 and the third pin 33 shown in FIG. 3 extends outward when bent horizontally, and the second pin 23 and the fourth pin 34 shown in FIG. 14 extends downward integrally; optionally, multiple local characteristics of the first embodiment and the second embodiment are available for each other in accordance with the need.

In conclusion, the design button point of the present disclosure are mainly that the push rod for pressing and pushing the moving contact is disposed between the button and the moving contact, and the track allowing the push rod to slide is disposed on the key; in this way, the slide part of the push rod is limited by the lower segment of the driving track in a free state; when the button is pressed, the slide part of the push rod slides upwards along the driving track to the upper segment of the reset track, and the press-push part of the push rod pushes the moving contact to be in contact with the static contact; and after the button is released, under the action force of the reset spring, the slide part of the push rod slides downwards along the reset track to the lower segment of the driving track, and is limited by the lower segment of the driving track again. As a result, the push rod type keyboard switch is simple in structure and easy to assemble and exhibits comfortable user experience; and the pressing control of the keyboard switch is accurate and smooth.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A switch, comprising:

a base, the base comprising a base plate, a base sidewall, and a guide column; the base plate comprising a base surface; and the guide column comprising an inner guide-column surface, an outer guide-column surface; and a limit groove;

a static contact;

a moving contact;

an upper cover, the upper cover comprising a cover through hole;

a button, the button comprising a press plate, a first button column, and a second button column; the press plate comprising an inner plate surface; the second button column comprising an outer button surface and a limit step; the limit step comprising a first limit surface and a second limit surface;

a reset spring; and a push rod, the push rod being of a U-shaped configuration; the push rod comprising a first transverse arm, a second transverse arm, and a vertical arm;

wherein:

the static contact and the moving contact are fixedly disposed on the base surface;

the base sidewall extends from the base surface;

the upper cover is installed on the base sidewall;

the button is inserted in the cover through hole;

the button is exposed out of the upper cover;

the inner plate surface is parallel to and faces the base surface;

the first button column and the second button column extend from the inner plate surface toward the base surface;

the first button column is disposed at a central portion of the inner plate surface, and the second button column is disposed around the first button column;

the guide column extends from the base surface toward the inner plate surface;

the first button column abuts against and is movable along the outer guide-column surface or the inner guide-column surface, wherein the outer guide-column surface or the inner guide-column surface that is abutted by the first button column is perpendicular to the base surface;

the reset spring is disposed around the guide column;

a gap is disposed between the first button column and the second button column;

the reset spring is disposed in the gap;

the reset spring abuts against the inner plate surface and the base surface;

the push rod is rotatably disposed on the base surface, and is disposed between the guide column and the moving contact;

the first transverse arm is disposed opposite the second transverse arm, and the vertical arm is connected to the first transverse arm and the second transverse arm;

the limit groove is recessed from the outer guide-column surface, and extends along a direction that is perpendicular to the base surface;

the first transverse arm is inserted in and movable along the limit groove;

the outer button surface is connected to the inner plate surface and faces the moving contact;

the limit step extends from the outer button surface toward the moving contact;

the first limit surface is connected to the outer button surface and faces the inner plate surface;

the first limit surface is parallel to the base surface;

a void space is defined by the inner plate surface, the outer button surface, and the first limit surface;

the second limit surface is connected to the first limit surface, and faces the moving contact;

distances between the second limit surface and the outer guide-column surface or the inner guide-column surface that is abutted by the first button column are increased along a direction that is perpendicular to the base surface from the base surface toward the inner plate surface;

the push rod is configured to press and move the moving contact;

when the button is in a free state, the push rod is limited by the limit step, the second transverse arm abuts against the second limit surface, the moving contact is pressed by the vertical arm, and the moving contact is spatially separated from the static contact;

when the button is in a pressed state, the second limit surface is moved toward the base surface such that the second transverse arm slides along the second limit surface to enter the void space; and after the second transverse arm enters the void space, the push rod is pivoted toward the base surface to move the vertical arm away from the moving contact such that the moving contact is released from the vertical arm to be in contact with the static contact; and when the button is released from the pressed state, under the action force of the reset spring, the limit step is moved away from the base surface, and the push rod is pivoted away from the base surface by the limit step to move the second transverse arm from the void space to the second limit surface such that the push rod is limited by the limit step.

2. The switch of claim 1, wherein the moving contact is of a U-shaped configuration, and comprises a fixed arm, an elastic arm, and a bending arm which is integrated with and connected to the fixed arm and the elastic arm; a free end of the elastic arm is provided with a first contact part; and the static contact is provided with a second contact part that is adapted to in contact with the first contact part.

3. The switch of claim 1, wherein a center of the button is provided with a first through hole, and the base is provided with a second through hole correspondingly; the first through hole faces and communicates with the second through hole directly in longitudinal direction; and a light source is disposed facing or in the first through hole.

4. The switch of claim 3, wherein a light guide column is disposed above the light source; and a light-emitting surface is disposed on a top end of the light guide column.

5. The switch of claim 1, wherein a fourth through hole is disposed on the base and deviates from a center of the base, and the light source is disposed in the fourth through hole; a place of the upper cover facing the light source is provided with a solid light transmission part or provided with a light transmission through hole; and a top end of the solid light transmission part is a light-emitting surface.

6. The switch of claim 5, wherein the solid light transmission part is integrated with the upper cover, and the upper cover is a non-opaque body.

* * * * *